US007604528B2

(12) United States Patent
Lo et al.

(10) Patent No.: US 7,604,528 B2
(45) Date of Patent: Oct. 20, 2009

(54) ELECTRIC GRINDING GUN

(75) Inventors: Ping-Hsin Lo, Taichung (TW); Chen-Chen Cheng, Taichung (TW)

(73) Assignee: Techway Industrial Co., Ltd., Taichung (TW)

( * ) Notice: Subject to any disclaimer, the term of this patent is extended or adjusted under 35 U.S.C. 154(b) by 0 days.

(21) Appl. No.: 12/072,733

(22) Filed: Feb. 28, 2008

(65) Prior Publication Data

US 2009/0221222 A1 Sep. 3, 2009

(51) Int. Cl.
*B24B 27/08* (2006.01)

(52) U.S. Cl. ..... 451/354; 173/216; 451/358; 451/359

(58) Field of Classification Search ..... 173/216, 173/217; 451/344, 354, 356, 357, 358, 359; 475/331

See application file for complete search history.

(56) References Cited

U.S. PATENT DOCUMENTS 4,597,453 A * 7/1986 Kilmer et al. ..... 173/171
5,269,733 A * 12/1993 Anthony, III ..... 475/331
5,897,454 A * 4/1999 Cannaliato ..... 475/265
6,899,653 B2 * 5/2005 Murphy ..... 475/317
6,915,721 B2 * 7/2005 Hsu et al. ..... 81/57.13
7,291,061 B2 * 11/2007 Kiss ..... 451/356
7,410,007 B2 * 8/2008 Chung et al. ..... 173/48
7,452,304 B2 * 11/2008 Hagan et al. ..... 475/298
2005/0090216 A1 * 4/2005 Hsu et al. ..... 455/184.1
2008/0190246 A1 * 8/2008 Hsu et al. ..... 81/57.13

* cited by examiner

*Primary Examiner*—Timothy V Eley
(74) *Attorney, Agent, or Firm*—William E. Pelton, Esq.; Cooper & Dunham LLP

(57) ABSTRACT

An electric grinding gun has a body, a gear reduction device, a holding cap, and an actuating device. The body has a casing, a rechargeable battery, a protective circuit board, a switch, a trigger, a motor, a cooling fin and a mounting barrel. The gear reduction device is rotatably mounted in the mounting barrel and has a seat, two planet gears and a gear ring. The seat is rotatably mounted in the mounting barrel and has a shaft hole, two gear recesses and a connecting axle. The holding cap is securely mounted around the mounting barrel to hold the gear reduction device in the mounting barrel and has an inner thread and a through hole. The actuating device is connected detachably to the seat of the gear reduction device and has a panel and an adhering layer.

10 Claims, 5 Drawing Sheets

ELECTRIC GRINDING GUN

BACKGROUND OF THE INVENTION

1. Field of the Invention

The present invention relates to a grinding gun, and more particularly relates to an electric grinding gun that can be used conveniently and easily.

2. Description of Related Art

Conventional grinding guns are usually used to grind and polish surfaces of wood or metal and include manual and automatic types. An automatic type of conventional grinding gun can be driven by a pneumatic or electric power. However, the conventional pneumatic or electric grinding gun has a complicated structure, a large volume and a heavy weight. Furthermore, the conventional pneumatic or electric grinding gun needs to connect with a power source and a user cannot bring the conventional pneumatic or electrical grinding gun to any desired location, and this is inconvenient in use.

To overcome the shortcomings, the present invention provides an electric grinding gun to mitigate or obviate the aforementioned problems.

SUMMARY OF THE INVENTION

The main objective of the present invention is to provide an electric grinding gun that can be used conveniently and easily.

The electric grinding gun in accordance with the present invention has a body, a gear reduction device, a holding cap, and an actuating device. The body has a casing, a rechargeable battery, a protective circuit board, a switch, a trigger, a motor, a cooling fin and a mounting barrel. The gear reduction device is rotatably mounted in the mounting barrel and has a seat, two planet gears and a gear ring. The seat is rotatably mounted in the mounting barrel and has a shaft hole, two gear recesses and a connecting axle. The holding cap is securely mounted around the mounting barrel to hold the gear reduction device in the mounting barrel and has an inner thread and a through hole. The actuating device is connected detachably to the seat of the gear reduction device and has a panel and an adhering layer.

Other objects, advantages and novel features of the invention will become more apparent from the following detailed description when taken in conjunction with the accompanying drawings.

DETAILED DESCRIPTION OF THE PREFERRED EMBODIMENT

Figure 1:
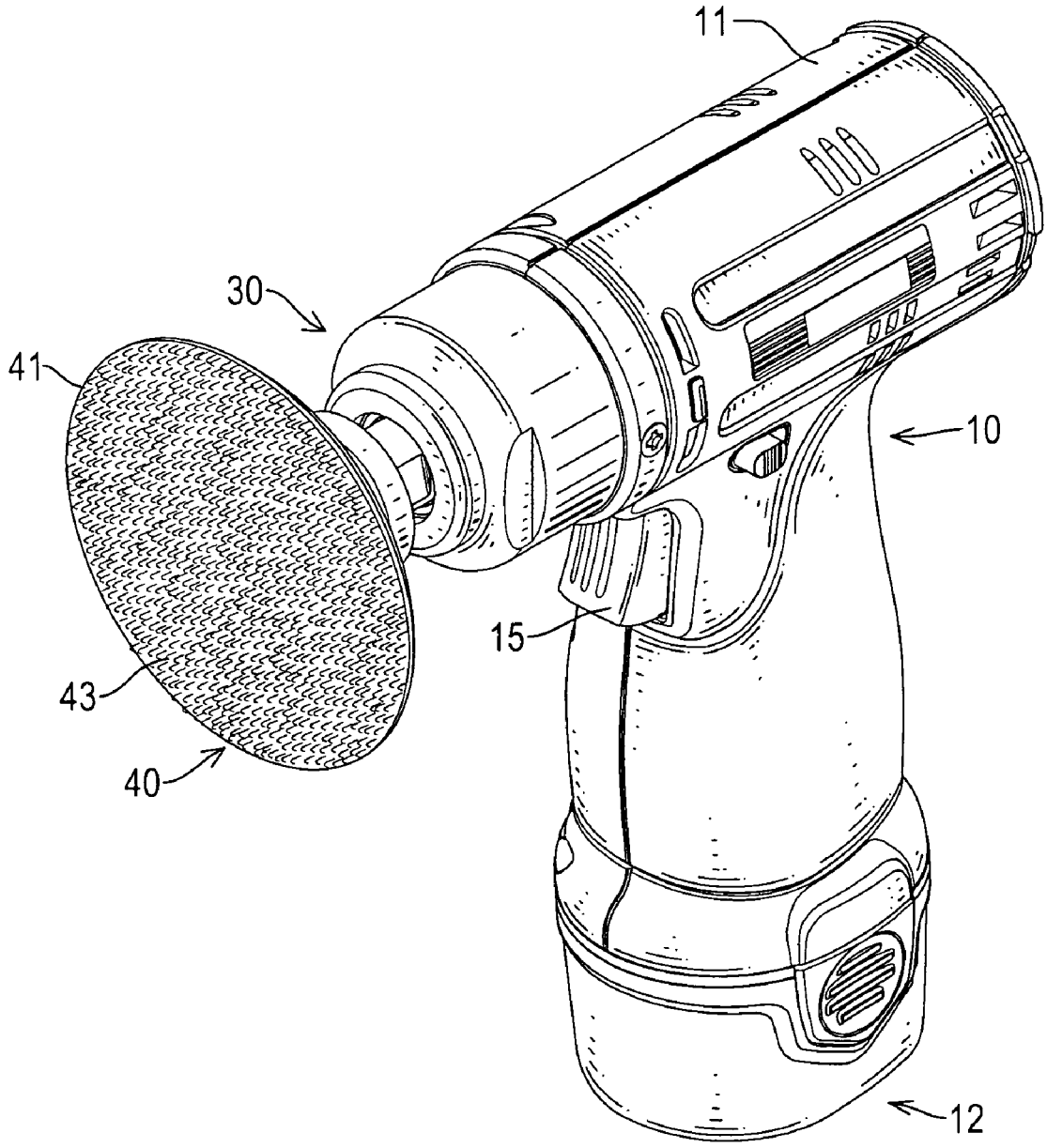
FIG. 1 is a perspective view of an electric grinding gun in accordance with the present invention.
Figure 2:
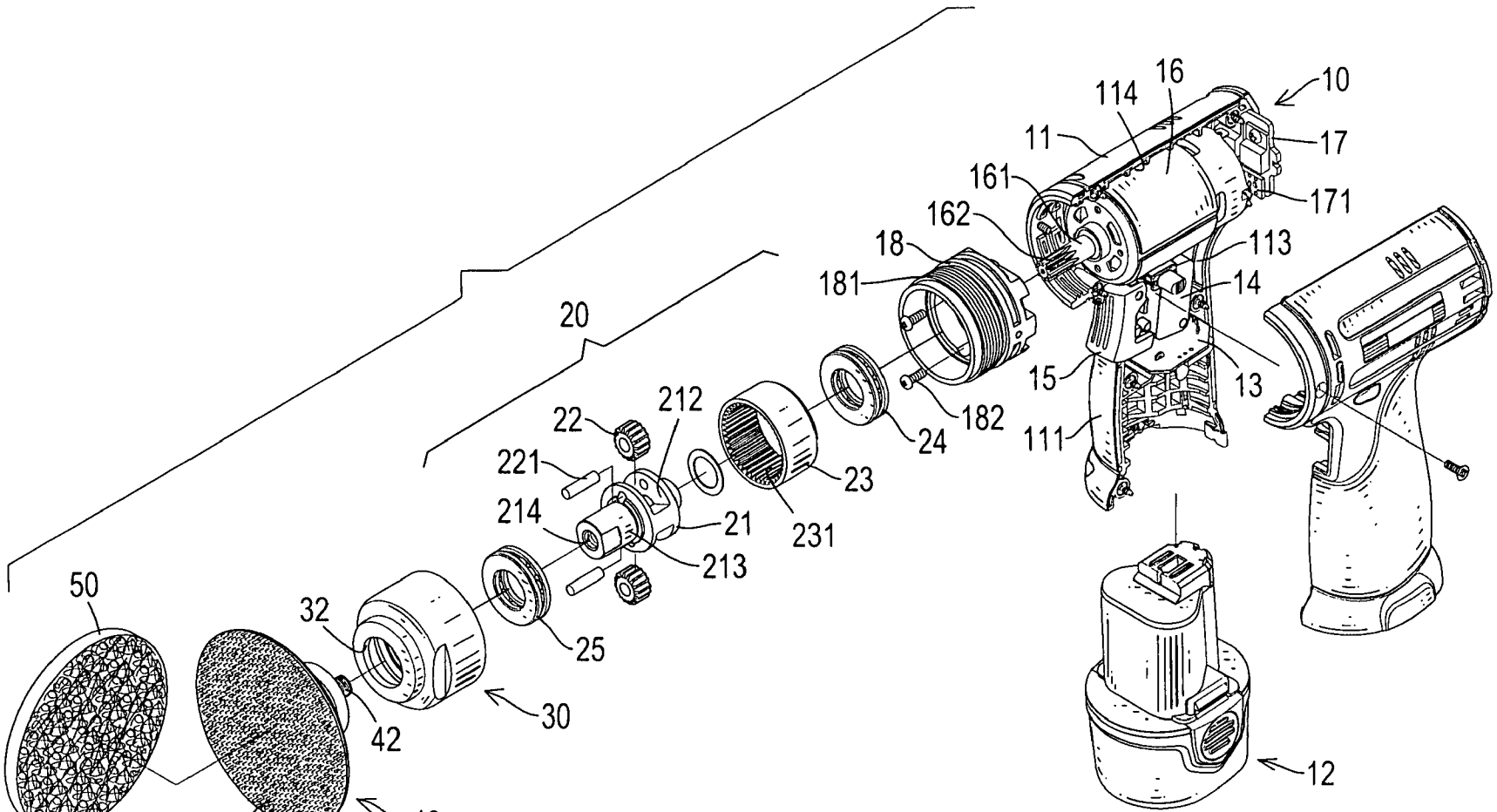
FIG. 2 is an exploded perspective view of the electric grinding gun in FIG. 1.
Figure 3:
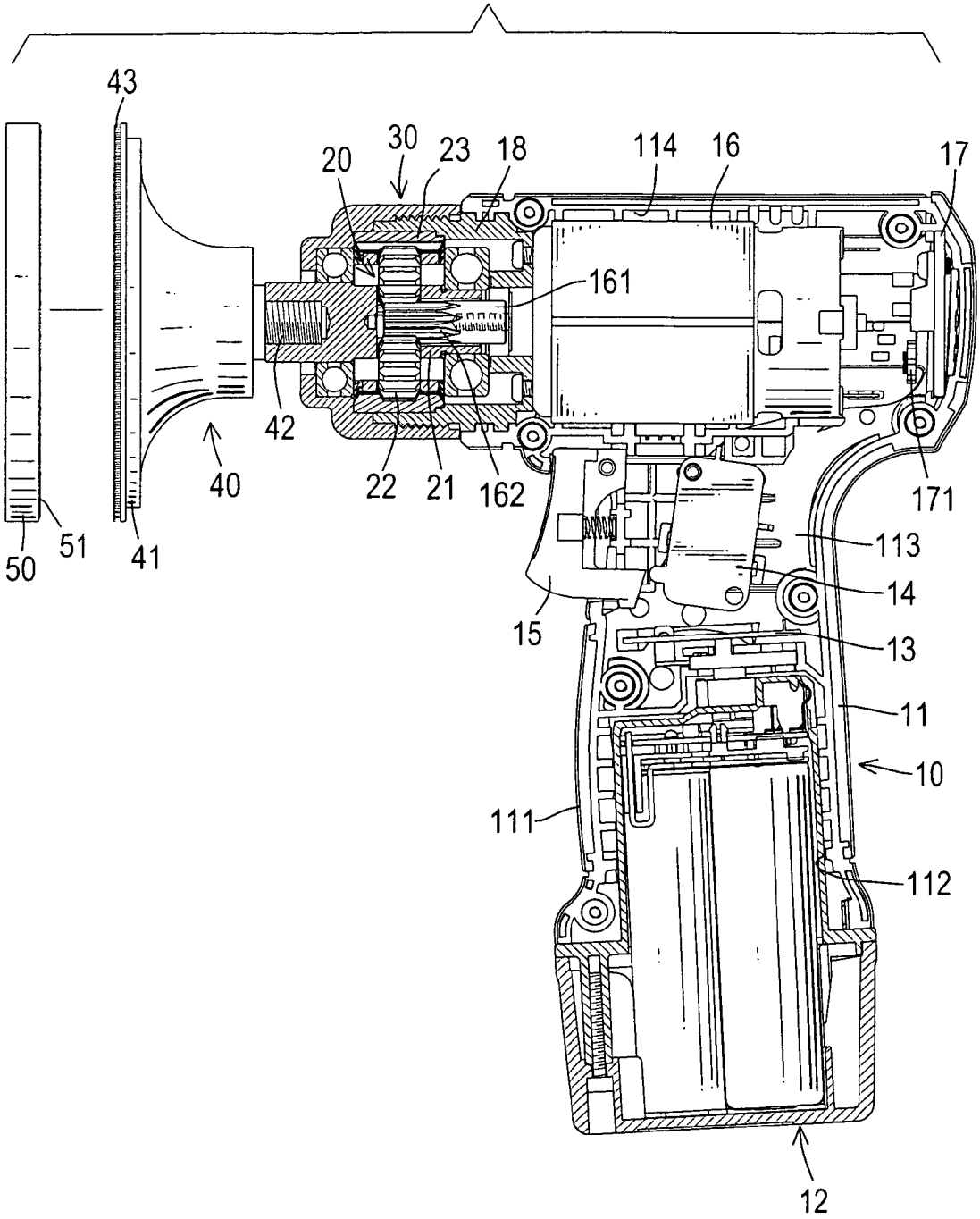
FIG. 3 is an exploded side view in partial section of the electric grinding gun in FIG. 1.

With reference to FIGS. 1 to 3, an electric grinding gun in accordance with the present invention comprises a body (10), a gear reduction device (20), a holding cap (30) and an actuating device (40).

The body (10) has a casing (11), a rechargeable battery (12), a protective circuit board (13), a switch (14), a trigger (15), a motor (16), a cooling fin (17) and a mounting barrel (18).

The casing (11) is hollow, is implemented with two half-casings and has a mounting section and a handle section (111). The mounting section has a front end, a rear end, an interior (114) and a front opening. The front opening is formed in the front end of the mounting section and communicates with the interior (114). The handle section (111) extends from the mounting section and has a top end, a lower end, a front, a chamber (112) and a mounting recess (113). The top end of the handle section (111) is formed on near the rear end of the mounting section. The chamber (112) is formed in and near the lower end of the handle section (111). The mounting recess (113) is formed in and near the top end of the handle section (111) and communicates with interior (114) and the chamber (112).

The rechargeable battery (12) is mounted detachably in the chamber (112) of the handle section (111).

The protective circuit board (13) is mounted in the chamber (112) near the top end and is electrically connected to the rechargeable battery (12).

The switch (14) is mounted in the mounting recess (113) and is electrically connected to the protective circuit board (13).

The trigger (15) is mounted in the front of the handle section (11) and contacts with the switch (14) when being pressed.

The motor (16) is mounted in the interior (114) of the casing (11), is electrically connected to switch (14) and the trigger (15) and has a front side, a rotating shaft (161) and multiple engaging teeth (162). The rotating shaft (161) is connected rotatably to the front side of the motor and has an external surface. The engaging teeth (162) are formed around the external surface of the rotating shaft (161).

The cooling fin (17) is mounted in the interior (114) of the casing (11) between the rear end of the mounting section and the motor (16) and has a controlling integrated circuit (171). The controlling integrated circuit (171) is mounted on the cooling fin (17).

The mounting barrel (18) is mounted on the front end of the mounting section of the casing (11) and communicates with the interior (114) and has a center, a rear end, a front end, an external surface, an outer thread (181) and two fasteners (182). The rear end of the mounting barrel (18) is mounted in the front end of the mounting section of the casing (11) and the rotating shaft (161) of the motor (16) extends in the center of the mounting barrel (18). The outer thread (181) is formed around the external surface of the mounting barrel (18) near the front end. The fasteners (182) are mounted through the mounting barrel (18) and are screwed into the front side of the motor (16) to connect the mounting barrel (18) with the motor (16).

Figure 4:
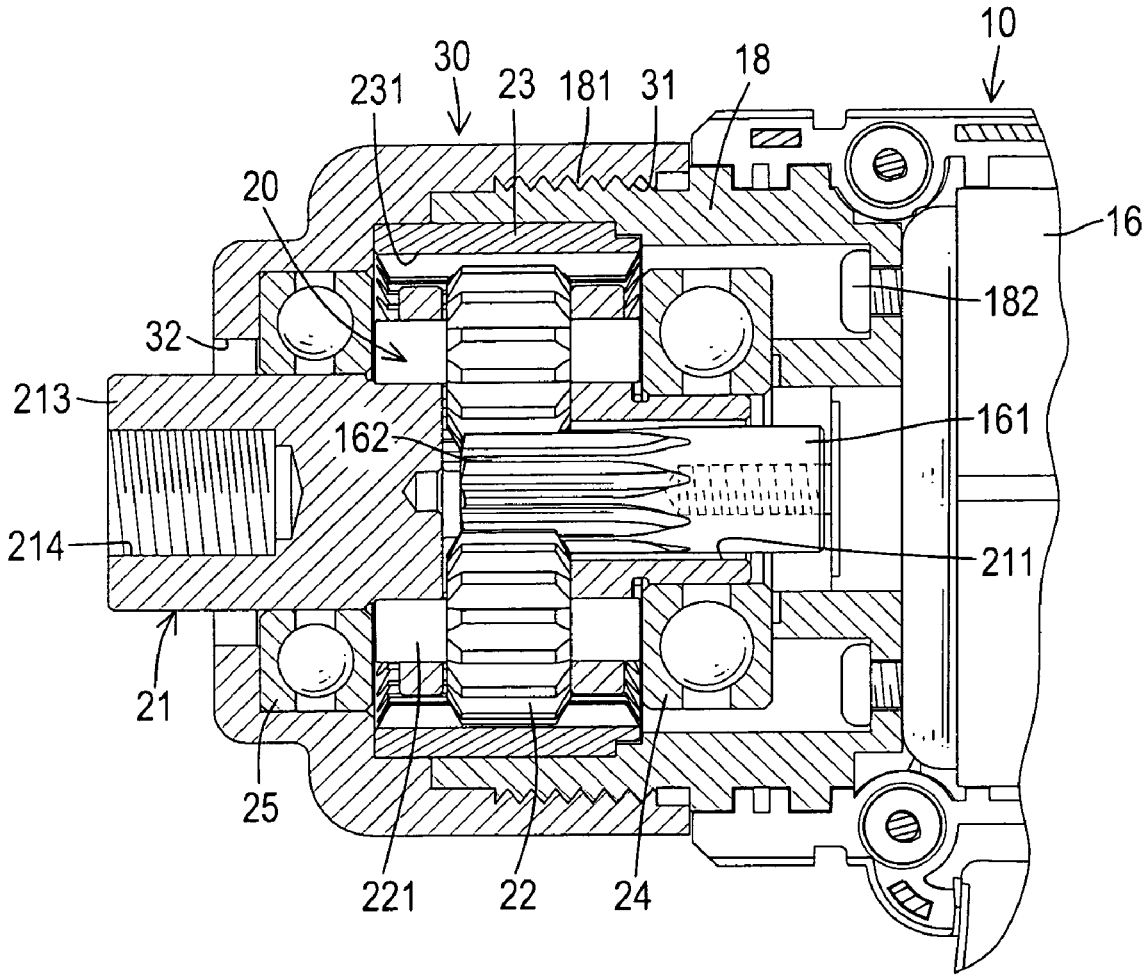
FIG. 4 is an enlarged side view in partial section of the electric grinding gun in FIG. 1.

With reference to FIGS. 2 to 4, the gear reduction device (20) is rotatably mounted in the mounting barrel (18) of the body (10) and has a seat (21), two planet gears (22), a gear ring (23) and two bearings (24, 25).

The seat (21) is rotatably mounted in the mounting barrel (18) of the body (10) and has a rear end, a front end, an external surface, a shaft hole (211), two gear recesses (212), a connecting axle (213) and a connecting hole (214). The shaft hole (211) is formed in the rear end of the seat (21) and is mounted around the rotating shaft (161) of the motor (16). The gear recesses (212) are formed in the external surface of the seat (21) near the rear end and align with the engaging teeth (162) of the motor (16). The connecting axle (213) is formed on and protrudes from the front end of the seat (21) and has a free end. The connecting hole (214) is axially formed in the free end of the connecting axle (213).

The planet gears (22) are rotatably mounted in the gear recesses (212) of the seat (21) and engage the engaging teeth (162) of the motor (16), and each planet gear (22) has a mounting post (221). The mounting posts (221) are connected to the seat (21) to hold the planet gears (22) in the gear recesses (212) of the seat (21).

The gear ring (23) is securely mounted in the mounting barrel (18) of the body (10), is mounted around the seat (21) and has an internal surface and multiple engaging teeth (231). The engaging teeth (231) are formed around the internal surface of the gear ring (23) and engage the planet gears (22) to make the seat (21) rotating relative to the gear ring (23).

One of the bearings (24) is mounted around the rear end of the seat (21), and the other bearing (25) is mounted around the connecting axle (213) of the seat (21).

The holding cap (30) is securely mounted around the mounting barrel (18) of the body (10) to hold the gear reduction device (20) in the mounting barrel (18) and has an internal surface, a front side, an inner thread (31) and a through hole (32). The inner thread (31) is formed around the internal surface of the holding cap (30) and engages the outer thread (181) of the mounting barrel (18). The through hole (32) is formed through the front side of the holding cap (30), and the connecting axle (213) of the seat (21) extends out of the through hole (32) of the holding cap (30).

Figure 5:
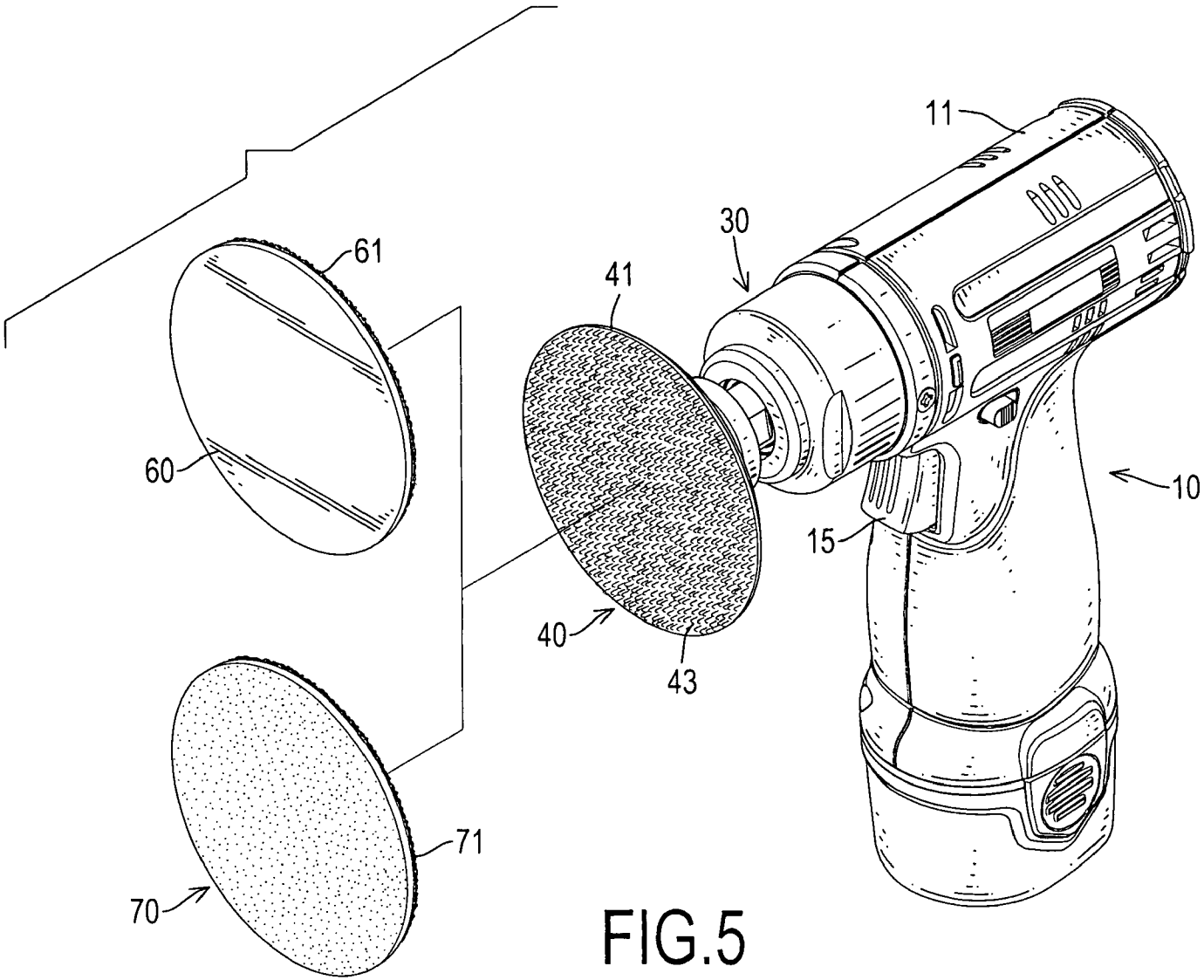
FIG. 5 is an exploded perspective view of alternative embodiments of an electric grinding gun in accordance with the present invention.

The actuating device (40) is connected detachably to the seat (21) of the gear reduction device (20) and has a panel (41) and an adhering layer (43). The panel (41) may be circular, is connected detachably to the connecting axle (213) of the seat (21) and has a rear side, a front side and a connecting head (42). The connecting head (42) is formed on and protrudes from the rear side of the panel (41) and is mounted in the connecting hole (214) of the seat (21). With further reference to FIGS. 2 and 5, the adhering layer (43) is mounted on the front side of the panel (41) and is used to connect with a grinding element. The grinding element can be a sponge plate (50), a wax paper sheet (60) or an abrasive paper (70). Each grinding element (50, 60, 70) has a rear side and an adhering layer (51, 61, 71) mounted on the rear side to connect with the adhering layer (43) of the actuating device (40).

With reference to FIGS. 2 to 4, when a person holds the handle section (111) of the casing (11) and pulls the trigger (15), the switch (14) and the protective circuit board (13) of the body (10) will drive the motor (16) to operate. The motor (16) is supplied power by the rechargeable battery (12). When the trigger (15) is pulled, the rotating shaft (161) of the motor (16) will rotate and the seat (21) will be rotated with the transmission of the engaging teeth (162, 231) on the rotating shaft (161), the planet gears (22) and the gear ring (23). Then, the actuating device (40) with the grinding element (50,60, 70) connected to the connecting axle (213) of the seat (21) can be rotated to grind and polish surfaces of wood or metal conveniently and easily. Furthermore, with the rechargeable battery (12), to connect to an external power source is unnecessary, so the electrical grinding gun can be carried to any desired location for operation and is convenient in use. With further reference to FIG. 5, the person can change the grinding element on the panel (41) of the actuating device (40) according to the material of unfashioned objects.

The electric grinding gun as described has the following advantages.

1. The body (10), the gear reduction device (20), the holding cap (30) and the actuating device (40) are composed to form a simplified, a small volume and a lightweight electric grinding gun.

2. The electrical grinding gun can be carried to any desired location for operation and is convenient in use.

2. The grinding gun can easily and conveniently grind and polish surfaces of wood or metal by pulling the trigger (15). Furthermore, the person can change the grinding element on the panel (41) of the actuating device (40) according to the material of unfashioned element by the adhering layers (43, 51, 61, 71) easily and quickly.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An electric grinding gun having a body having a casing being hollow;

a rechargeable battery being mounted detachably in the casing;

a protective circuit board being mounted in the casing and being electrically connected to the rechargeable battery;

a switch being mounted in the casing and being electrically connected to the protective circuit board of the body;

a motor being mounted in the casing and being electrically connected to the switch and having a front side;

a rotating shaft being connected rotatably to the front side of the motor and having an external surface; and multiple engaging teeth being formed around the external surface of the rotating shaft;

a cooling fin being mounted in the casing near the motor; and a mounting barrel being mounted on the casing;

a gear reduction device being rotatably mounted in the mounting barrel of the body and having a seat being rotatably mounted in the mounting barrel of the body and having a rear end;

a front end;

an external surface;

a shaft hole being formed in the rear end of the seat and being mounted around the rotating shaft of the motor;

two gear recesses being formed in the external surface of the seat near the rear end and aligning with the engaging teeth of the motor; and a connecting axle being formed on and protruding from the front end of the seat and having a free end;

two planet gears being rotatably mounted in the gear recesses of the seat and engaging the engaging teeth on the rotating shaft, and each planet gear having a mounting post connected to the seat to hold the planet gear in a corresponding gear recess of the seat; and a gear ring being securely mounted in the mounting barrel of the body, being mounted around the seat and having an internal surface; and multiple engaging teeth being formed around the internal surface of the gear ring and engaging the planet gears to make the seat rotating relative to the gear ring;

a holding cap being securely mounted around the mounting barrel of the body to hold the gear reduction device in the mounting barrel and having a front side; and a through hole being formed through the front side of the holding cap, wherein the connecting axle of the seat extends out of the through hole of the holding cap; and an actuating device being connected detachably to the seat of the gear reduction device and having a panel being connected detachably to the connecting axle of the seat and having a front side; and an adhering layer being mounted on the front side of the panel.

2. The electric grinding gun as claimed in claim 1, wherein the casing is composed of two half-casings and has a mounting section having a front end;

a rear end; and a front opening being formed in the front end of the mounting section; and a handle section extending from the mounting section and having a top end being formed on the mounting section near the rear end of the mounting section;

a lower end; and a front; and the body further has a trigger being mounted in the front of the handle section and contacting with the switch when being pulled.

3. The electric grinding gun as claimed in claim 2, wherein the mounting barrel is mounted on the front end of the mounting section of the casing and further has two fasteners being mounted through the mounting barrel and screwed into the front side of the motor to connect the mounting barrel with the motor.

4. The electric grinding gun as claimed in claim 3, wherein the mounting barrel further has a center to which the rotating shaft of the motor extends;

a rear end being mounted in the front end of the mounting section of the casing;

a front end;

an external surface; and an outer thread being formed around the external surface of the mounting barrel near the front end; and the holding cap further has an internal surface; and an inner thread being formed around the internal surface of the holding cap and engaging the outer thread of the mounting barrel.

5. The electric grinding gun as claimed in claim 4, wherein the actuating device further has a sponge plate being connected to the adhering layer and having a rear side; and an adhering layer being mounted on the rear side of the sponge plate to connect with the adhering layer of the actuating device.

6. The electric grinding gun as claimed in claim 4, wherein the actuating device further has a wax paper sheet being connected to the adhering layer and having a rear side; and an adhering layer being mounted on the rear side of the wax paper sheet to connect with the adhering layer of the actuating device.

7. The electric grinding gun as claimed in claim 4, wherein the actuating device further has an abrasive paper plate being connected to the adhering layer and having a rear side; and an adhering layer being mounted on the rear side of the abrasive paper plate to connect with the adhering layer of the actuating device.

8. The electric grinding gun as claimed in claim 1, wherein the seat of the gear reduction device further has a connecting hole being axially formed in the free end of the connecting axle; and the panel of the actuating device further has a rear side; and a connecting head being formed on and protruding from the rear side of the panel and being mounted in the connecting hole of the seat.

9. The electric grinding gun as claimed in claim 8, wherein the gear reduction device further has two bearings, and one of the bearings is mounted around the rear end of the seat and the other bearing is mounted around the connecting axle of the seat.

10. The electric grinding gun as claimed in claim 2, wherein the mounting section of the casing further has an interior communicating with the opening of the mounting section;

the handle section of the casing further has a chamber being formed in the handle section near the lower end of the handle section; and a mounting recess being formed in and near the top end of the handle section and communicating with the interior and the chamber;

the rechargeable battery is mounted in the chamber of the handle section;

the protective circuit board is mounted in the chamber near the top end of the handle section;

the switch is mounted in the mounting recess of the handle section;

the cooling fin is mounted in the interior between the rear end of the mounting section and the motor and has a controlling integrated circuit being mounted on the cooling fin; and the panel is circular.

* * * * *